US007358792B2

(12) United States Patent
Taki et al.

(10) Patent No.: US 7,358,792 B2
(45) Date of Patent: Apr. 15, 2008

(54) DISCHARGE DEVICE AND DC POWER SUPPLY SYSTEM

(75) Inventors: Konosuke Taki, Sendai (JP); Hidetaka Fukazawa, Miyagi (JP); Shintaroh Murakami, Sendai (JP)

(73) Assignee: Freescale Semiconductor, Inc., Austin, TX (US)

( * ) Notice: Subject to any disclaimer, the term of this patent is extended or adjusted under 35 U.S.C. 154(b) by 59 days.

(21) Appl. No.: 11/503,650

(22) Filed: Aug. 14, 2006

(65) Prior Publication Data

US 2007/0046276 A1 Mar. 1, 2007

(30) Foreign Application Priority Data

Aug. 23, 2005 (JP) ..... 2005-241621

(51) Int. Cl.
*G05F 3/04* (2006.01)

(52) U.S. Cl. ..... 327/530; 323/312

(58) Field of Classification Search ..... 327/530, 327/538, 544; 323/312, 237
See application file for complete search history.

(56) References Cited

U.S. PATENT DOCUMENTS 5,861,735 A * 1/1999 Uchida ..... 323/271

* cited by examiner

*Primary Examiner*—Dinh T. Le
(74) *Attorney, Agent, or Firm*—Charles Bergere

(57) ABSTRACT

A discharge device and DC power supply system for preventing erroneous operation of a series regulator. The discharge circuit includes a voltage comparison circuit for comparing input power supply voltage and output power supply voltage of the series regulator. The voltage comparison circuit includes first and second transistors. The collector terminal of the second transistor is connected to the drain terminal of a fourth transistor and to the gate terminal of a fifth transistor. The fifth transistor has a drain terminal, which is connected to the output terminal of the series regulator, and a source terminal, which is grounded. Third and fourth transistors operate when the input power supply voltage is greater than the activation voltage. The drain terminal of the fourth transistor is grounded via a resistor, and the voltage of the fourth transistor is supplied to the gate terminal of the fifth transistor.

6 Claims, 4 Drawing Sheets

DISCHARGE DEVICE AND DC POWER SUPPLY SYSTEM

BACKGROUND OF THE INVENTION

The present invention relates to a discharge device and a DC power supply system for preventing erroneous operation in a power supply stabilizer.

Nowadays, series regulators (power supply stabilizers) are often used to stabilize power supplies. When an input power supply voltage exceeds an activation voltage in these series regulators, a predetermined voltage is output from the output terminal. Normally, a stabilizing capacitor is arranged at the output terminal (for example, refer to Japanese Laid-Open Patent Publication No. 2004-129489). Then, when the input power supply voltage of the series regulator drops below the activation voltage, the series regulator stops operating.

When the input power supply voltage of the series regulator is higher than the series regulator activation voltage, the series regulator enters operates even when the input power supply voltage of the series regulator is less than the output power supply voltage. The charge accumulated in the stabilizing capacitor connected to the output side power supply terminal is supplied to each block connected to the output terminal as the regulator output.

Due to the stabilizing capacitor connected to the output terminal of the series regulator, when the input power supply voltage becomes lower than the activation voltage, output voltage is supplied from the series regulator due to the residual voltage that is still in the stabilizing capacitor. Therefore, there is a possibility of the series capacitor operating even through the blocks connected to the output terminal are expecting the operation to be stopped.

Furthermore, the series regulator operates when the input power supply voltage of the series regulator is lower than the output power supply voltage and higher than the series regulator activation voltage. Thus, residual charge accumulates in the stabilizing capacitor connected to the output side power supply terminal. The residual charge may produce load current that causes an erroneous operation.

SUMMARY OF THE INVENTION

It is an object of the present invention to provide a discharge device and DC power supply system for preventing erroneous operation of a power supply stabilizer.

One aspect of the present invention is a discharge device connected to an output terminal of a power supply stabilizing device. The discharge device includes a comparison means for comparing input power supply voltage and output power supply voltage of the power supply stabilizing device. An acquisition means acquires a comparison signal of a reference voltage and the input power supply voltage from the power supply stabilizing device. A control device includes a first terminal, which is connected to the output terminal of the power supply voltage stabilizing device, a second terminal, which is grounded, and a control terminal, which is connected to the comparison means and the acquisition means. The comparison means controls the control device such that the output power supply voltage follows the input power supply voltage when the input power supply voltage becomes lower than or equal to the output power supply voltage. The acquisition means controls the control device such that the output terminal is grounded when the input power supply voltage becomes lower than or equal to the reference voltage.

A further aspect of the present invention is a DC power supply system including the discharge device of the first aspect. The DC power supply system further includes a voltage source for supplying the power supply stabilizing device with the input power supply voltage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
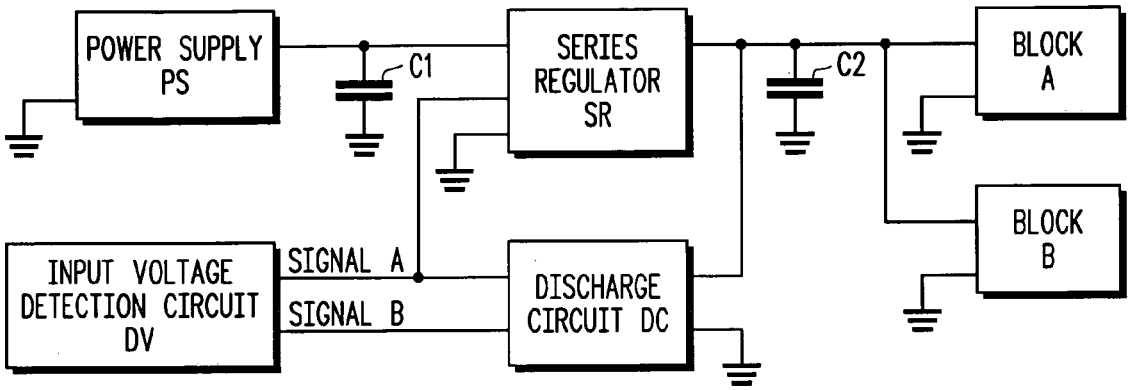
FIG. 1 is a block diagram of a preferred embodiment of the present invention.

A discharge circuit DC according to a preferred embodiment of the present invention will now be described below with reference to FIG. 1. The discharge circuit DC is applicable to a series regulator SR as a power supply stabilizer connected to a voltage source.

Input power supply voltage V1 is supplied from a power supply to an input terminal RIN of the series regulator SR. In this case, a capacitor C1 is connected to the input terminal RIN to stabilize the input voltage. The input power source voltage V1 is also supplied to the capacitor C1.

In the series regulator SR, the input power supply voltage V1 is converted to output power supply voltage V2 and output from an output terminal ROUT. The output power supply voltage V2 is also supplied to a stabilizing capacitor C2. Then, the output power supply voltage V2 is supplied to blocks A and B. The blocks A and B are functional circuit blocks that operate using the output power supply voltage V2 as a power source.

The series regulator SR operates only when the input voltage is greater than or equal to a predetermined activation voltage, which functions as a reference voltage. Therefore, an input voltage detection circuit DV is used to detect the input voltage. The output of the input voltage detection circuit DV is provided to the series regulator SR. A signal "A", which is an output by the input voltage detection circuit DV, is output at a high level signal when the input power supply voltage V1 is greater than or equal to the activation voltage of the series regulator SR. The signal A is output at a low level when the input voltage V1 is less than the activation voltage. The series regulator SR operates only when the signal A is high. The input voltage detection circuit outputs the signal A at a high level only when a signal B has a high level.

The input voltage detection circuit DV outputs the signal B. The signal B is output at a high level when the input power supply voltage V1 is greater than or equal to the minimum operating voltage of the system, and output at a low level when the input voltage V1 is less than the minimum operating voltage.

The signals A and B of the input voltage detection circuit DV are provided to the discharge circuit DC. The output terminal ROUT of the series regulator SR is grounded through the discharge circuit DC.

Figure 2:
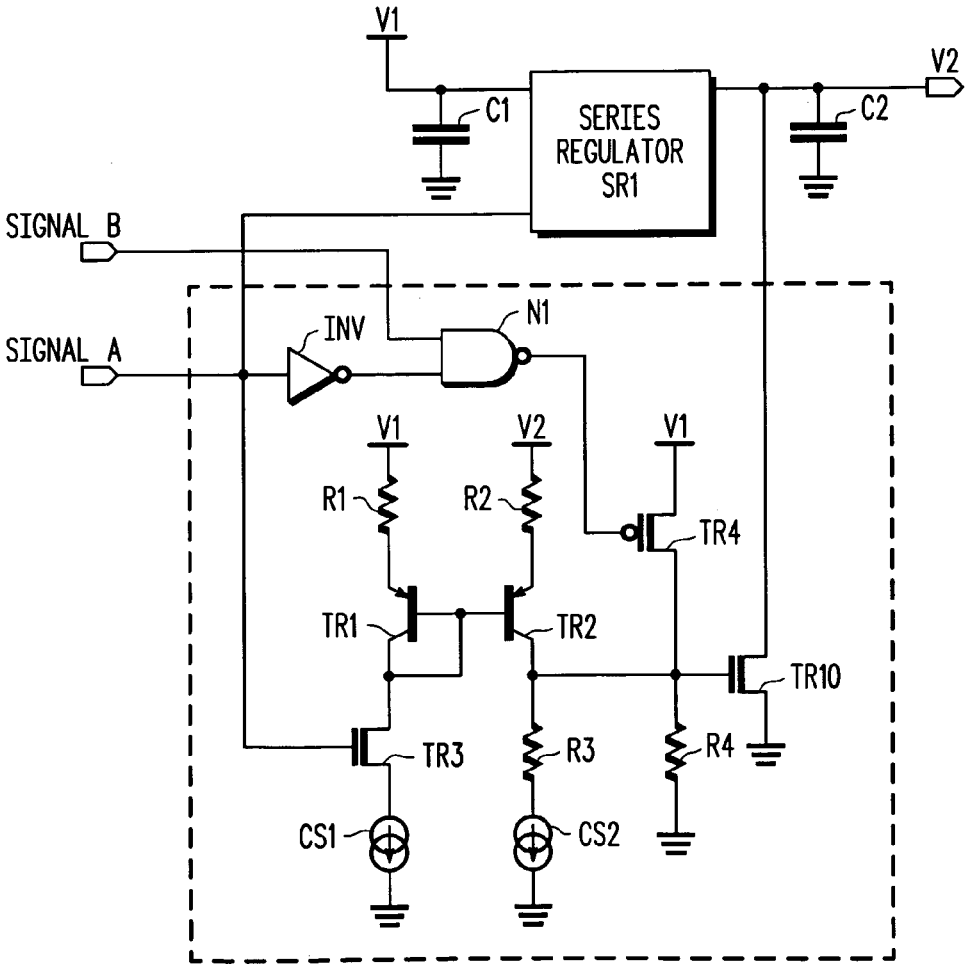
FIG. 2 is a circuit diagram of the preferred embodiment of the present invention.

The discharge circuit DC will now be described with reference to FIG. 2.

The discharge circuit DC includes a voltage comparison circuit, which functions as a comparing means for comparing the input power supply voltage V1 and the output power supply voltage V2. The voltage comparison circuit includes a transistor Tr1 and a transistor Tr2, which are pnp-type bipolar transistors. The transistor Tr1 has a device input terminal (emitter terminal) supplied with the input power supply voltage V1 via a resistor R1. The transistor Tr1 also has a device output terminal (collector terminal) connected to the drain terminal of an n-type MOS transistor Tr3. The signal A is input to the gate terminal of the transistor Tr3. The source terminal of the transistor Tr3 is grounded via a constant current source CS1.

The base terminal (control terminal) of the transistor Tr1 is connected to the collector terminal of the transistor Tr1 and the base terminal of the transistor Tr2. The output power supply voltage V2 is supplied to the emitter terminal of the transistor Tr2 via a resistor R2. The collector terminal of the transistor Tr2 is connected to a resistor R3 and further grounded through a constant current source CS2.

The signal A provided to the discharge circuit DC is input to a NAND device N1 via an inverter INV. The signal B is also input to the NAND device N1. Accordingly, the output of the NAND device N1 is low only when the signal A is low and the signal B is high.

The output of the NAND device N1 is provided to a transistor Tr4. The input power supply voltage V1 is supplied to the source terminal of the transistor Tr4, which is a p-type MOS transistor. The drain terminal of the transistor Tr4 is grounded via a resistor R4.

The collector terminal of the transistor Tr2 is connected to the drain terminal of the transistor Tr4. The drain terminal is also connected to the gate terminal (control terminal) of a transistor Tr10, which is an n-type MOS transistor. In this case, the transistor Tr10 has a drain terminal (first terminal) connected to the output terminal of the series regulator SR and a source terminal (second terminal), which is grounded.

The operation of the discharge circuit DC will now be described.

The signals A and B are high when the input power supply voltage V1 of the series regulator SR is higher than the activation voltage and the input power supply voltage V2 is higher than or equal to the minimum operating voltage of the system. The discharge circuit DC is in a normal operation mode when the input power supply voltage V1 is higher than the output power supply voltage. In this case, the transistor Tr3 is turned on, and the transistor Tr4 is turned off. Furthermore, when the input power supply voltage V1 is higher than the output power supply voltage V2, the transistor Tr2 is turned off since a bias current does not flow thereto. Therefore, the transistor Tr10 is turned off.

When the input power supply voltage V1 is lower than the output power supply voltage V2, bias current flows to the transistor Tr2. As a result, the transistor Tr2 is turned on, and the constant current source CS2 generates voltage at the resistor R3. The voltage of the resistor R3 is supplied to the gate terminal of the transistor Tr10. This turns on the transistor Tr10. Thus, the transistor Tr10 forcibly discharges the capacitor C2. The transistor Tr10 remains on until the output power supply voltage V2 becomes equal to the input power supply voltage V1. The normal operation mode is started when the output power supply voltage V2 becomes equal to the input power supply voltage V1. That is, bias current does not flow to the transistor Tr2. This turns off the transistor Tr2 grounds the gate terminal of the transistor Tr10 via the resistor R4. As a result, the transistor Tr10 is turned off, and the discharging of the capacitor C2 is stopped. In this manner, the output power supply voltage V2 is rapidly discharged by the discharge circuit DC until it becomes equal to the input power supply voltage V1 so that the output power supply voltage V2 is controlled to follow the input power supply voltage V1. This discharges the residual voltage of the stabilizing capacitor (capacitor C2), connected to the output side power supply terminal, without depending on a load current within a short period of time.

The signal A is low and the signal B is high when the input power supply voltage V1 of the series regulator SR is lower than the activation voltage and the input power supply voltage V1 is higher than the minimum operating voltage of the system. In this case, the transistor Tr4 is turned on. Therefore, the input power supply voltage V1 is supplied to the gate terminal of the transistor Tr10 to turn on the transistor Tr10. Then, the transistor Tr10 forcibly discharges the capacitor C2 until reaching the GND level.

The signals A and B are both low when the input power supply voltage V1 of the series regulator SR is lower than the activation voltage and the input power supply voltage V1 is lower than the minimum operating voltage of the system. In this case, the discharge circuit DC is not operated.

Figure 3:
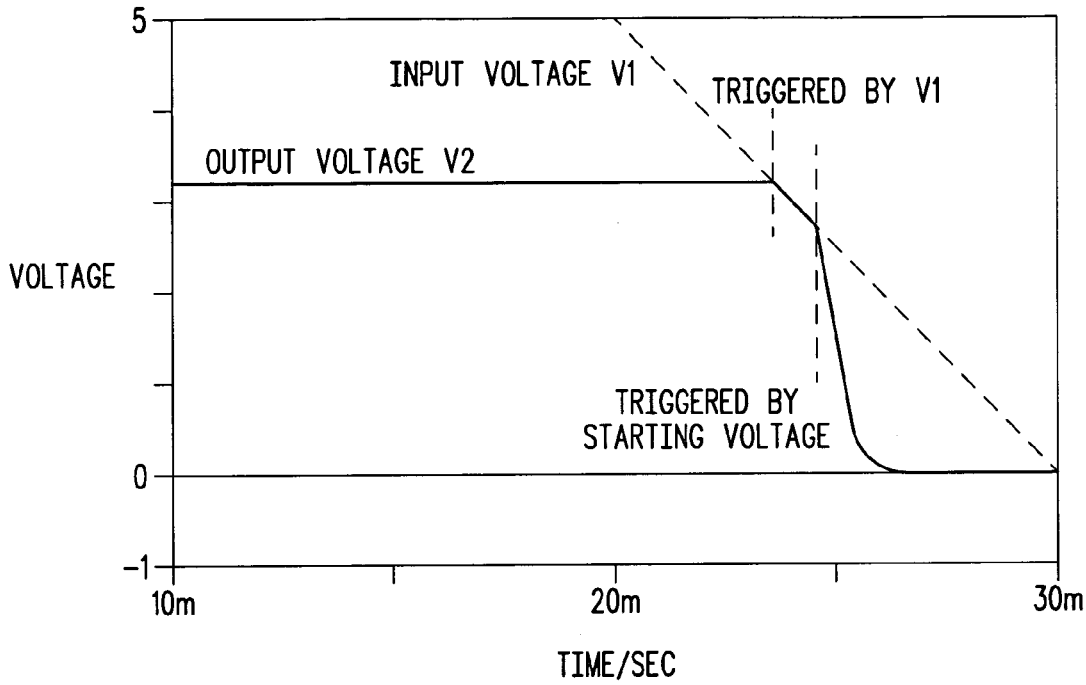
FIG. 3 is a graph showing the voltage-time characteristics of the preferred embodiment.

As a result, as shown in FIG. 3, the output power supply voltage V2 follows the input power supply voltage V1 and falls when the input power supply voltage V1 decreases and becomes lower than the output power supply voltage V2. Furthermore, when the input power supply voltage V1 becomes lower than the activation voltage, the output power supply voltage V2 falls to the GND level.

The preferred embodiment has the advantages described below.

In the preferred embodiment, when the input power supply voltage V1 of the series regulator SR is lower than the output power supply voltage V2 and higher than the activation voltage, the discharge circuit DC rapidly discharges the output power supply voltage V2 to the input power supply voltage V1. This controls the output power supply voltage V2 so as to follow the input power supply voltage V1. Thus, the residual voltage of the capacitor C2 connected to the output side power supply terminal is discharged within a short period of time without depending on load current. That is, the residual voltage of the load capacitor connected to the output side is positively drawn out by the discharge circuit DC and not discharged by a load current. This shortens the instable period at the output side. Furthermore, the generation of a short mode that produces a large current is suppressed due to the gradual discharge.

In the preferred embodiment, when the input power supply voltage V1 becomes lower than the activation voltage, the discharge circuit DC rapidly discharges the output side power supply to the GND level. Such discharge sequences prevent erroneous operation of blocks operated by the output of the series regulator SR that functions as a power supply.

It should be apparent to those skilled in the art that the present invention may be embodied in many other specific forms without departing from the spirit or scope of the invention. Particularly, it should be understood that the present invention may be embodied in the following forms.

In the preferred embodiment, the transistors Tr1-Tr10 are bipolar transistors or MOS-type transistors but are not limited to such transistors.

Figure 4:
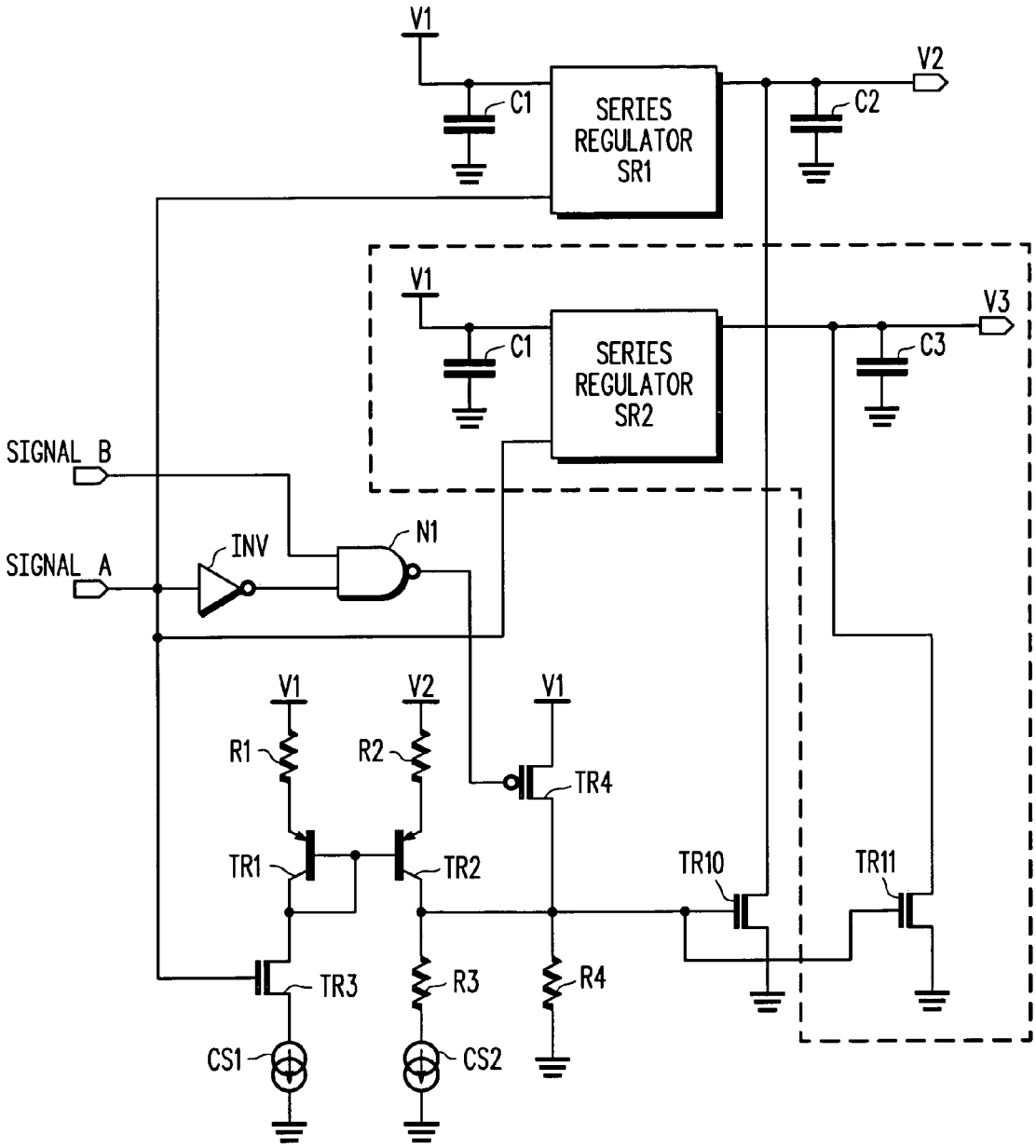
FIG. 4 is a circuit diagram of a further embodiment of the present invention.
Figure 5:
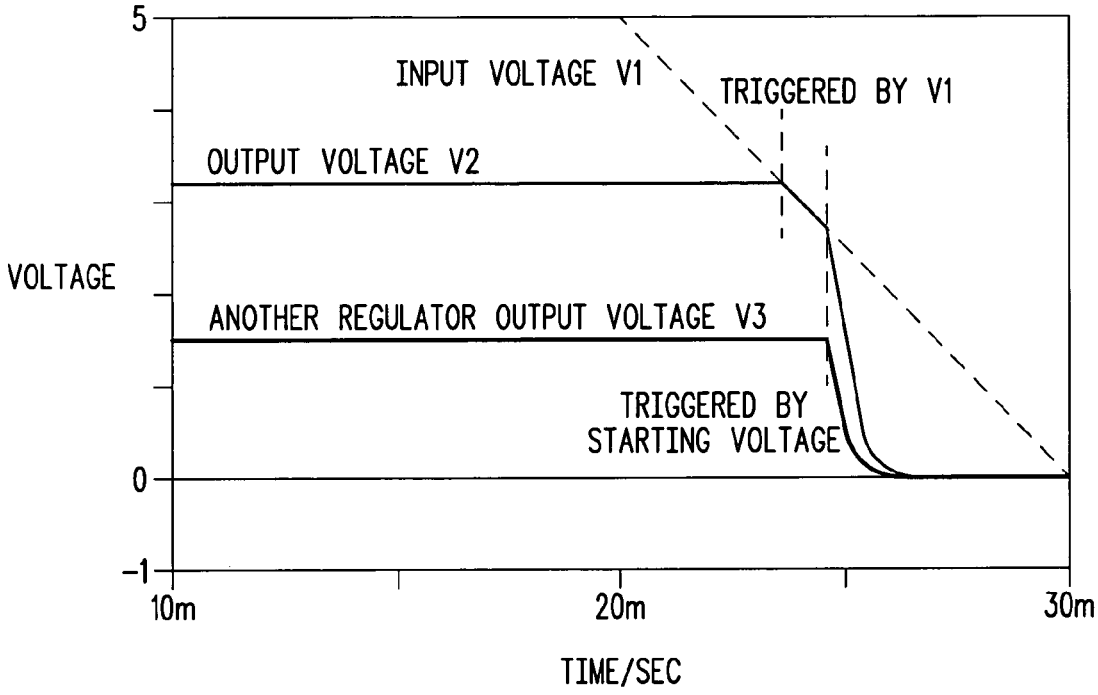
FIG. 5 is a graph showing the voltage-time characteristics of the further embodiment.

In the preferred embodiment, one discharge circuit DC is provided for one series regulator SR. However, a plurality of series regulators SR1 and SR2 may be connected to the discharge circuit DC. In this case, the discharge circuit DC is arranged in the series regulator SR1, which has the highest output voltage, as shown in FIG. 4. Specifically, a transistor Tr11, which functions as a control device, is arranged in the series regulator SR2. When the series regulator activation voltage becomes less than the input power supply voltage, the transistor Tr11 operates in cooperation with the transistor Tr10 and simultaneously discharges the output power supply terminal of the series regulator SR2. Accordingly, when the output power supply voltage V3 of the series regulator SR2 becomes less than the activation voltage, the output power supply voltage V3 is forcibly reduced to the GND level by the single discharge circuit DC, as shown in FIG. 5.

The present examples and embodiments are to be considered as illustrative and not restrictive, and the invention is not to be limited to the details given herein, but may be modified within the scope and equivalence of the appended claims.

What is claimed is:

1. A discharge device connected to an output terminal of a power supply stabilizing device, the discharge device comprising:

a comparison means for comparing an input power supply voltage and an output power supply voltage of the power supply stabilizing device;

an acquisition means for receiving a comparison signal, wherein the comparison signal is a comparison of an activation voltage and the input power supply voltage of the power supply stabilizing device; and a control device, connected to the comparison means and the acquisition means, including a first terminal connected to the output terminal of the power supply voltage stabilizing device, a second terminal, which is grounded, and a control terminal, which is connected to the comparison means and the acquisition means;

wherein the comparison means controls the control device such that the output power supply voltage follows the input power supply voltage when the input power supply voltage becomes lower than or equal to the output power supply voltage; and the acquisition means controls the control device such that the output terminal is grounded when the input power supply voltage becomes lower than or equal to the activation voltage.

2. The discharge device according to claim 1, wherein:

the comparison means includes a first transistor that receives the input power supply voltage, a second transistor that receives the output power supply voltage, and a third transistor;

the first transistor includes a device output terminal and a control terminal that are connected to each other, and the third transistor includes a device input terminal, which is connected to the device output terminal of the first transistor, and a device output terminal, which is grounded via a first constant current source;

the second transistor includes a control terminal, which is connected to the control terminal of the first transistor, and a device output terminal, which is grounded via a second constant current source; and the third transistor includes a control terminal for receiving the comparison signal.

3. A DC power supply system comprising the discharge device according to claim 1, and further comprising a power supply for supplying the power supply stabilizing device with the input power supply voltage.

4. A discharge device connected to a series regulator, the discharge device comprising:

a comparison circuit for comparing an input power supply voltage and an output power supply voltage of the series regulator, wherein the comparison includes first, second and third transistors;

a fourth transistor that receives a comparison signal of a reference voltage and the input power supply voltage; and a control transistor, connected to the comparison circuit and the fourth transistor, the control transistor having a first terminal connected to the output terminal of the power supply voltage stabilizing device, a second terminal connected to ground, and a control terminal connected to the fourth transistor;

wherein the comparison circuit controls the control transistor such that the output power supply voltage follows the input power supply voltage when the input power supply voltage becomes lower than or equal to the output power supply voltage; and the fourth transistor controls the control transistor such that the output terminal is grounded when the input power supply voltage becomes lower than or equal to the reference voltage.

5. The discharge device of claim 4, wherein:

the first transistor has a first terminal connected to a power supply and receives the input power supply voltage, a second terminal connected to a first terminal of the third transistor, and a third terminal connected to its second terminal;

the second transistor has a first terminal connected to the series regulator and receives the output power supply voltage, a second terminal connected to ground by way of a first current source, and a third terminal connected to the third terminal of the first transistor; and the third transistor has a second terminal connected to ground by way of a second current source, and a third terminal connected to a voltage detection circuit.

6. The discharge device of claim 4, wherein the discharge device is connected to at least two series regulators, wherein the discharge devices comprises a corresponding number of control transistors, wherein each of the series regulators is connected to a respective one of the control transistors.

* * * * *